US006814267B2

(12) United States Patent
Ingram

(10) Patent No.: US 6,814,267 B2
(45) Date of Patent: Nov. 9, 2004

(54) FLOW CONTROL DEVICE FOR LARGE CAPACITY CONTAINER

(75) Inventor: Vicki Ingram, Emporia, KS (US)

(73) Assignee: Hopkins Manufacturing Corporation, Emporia, KS (US)

( * ) Notice: Subject to any disclaimer, the term of this patent is extended or adjusted under 35 U.S.C. 154(b) by 177 days.

(21) Appl. No.: 10/116,211

(22) Filed: Apr. 2, 2002

(65) Prior Publication Data

US 2003/0183662 A1 Oct. 2, 2003

(51) Int. Cl.[7] ..... B67D 3/00
(52) U.S. Cl. ..... 222/520
(58) Field of Search ..... 222/519, 520, 222/522, 523, 525, 549

(56) References Cited

U.S. PATENT DOCUMENTS

| | | | | | |
|---|---|---|---|---|---|
| 733,701 | A | * | 7/1903 | Dalton | 222/520 |
| 2,841,314 | A | * | 7/1958 | Munson et al. | 222/519 |
| 3,828,981 | A | * | 8/1974 | Linkletter | 222/549 |
| 4,261,487 | A | * | 4/1981 | Seager | 222/520 |
| 4,392,584 | A | | 7/1983 | Bauer | |
| 4,583,668 | A | * | 4/1986 | Maynard, Jr. | 222/529 |
| 4,700,861 | A | | 10/1987 | Neward | |
| 4,739,892 | A | | 4/1988 | Tudek | |
| 4,819,815 | A | * | 4/1989 | Tarlow et al. | 222/553 |
| 4,828,128 | A | | 5/1989 | Tackles | |
| 4,856,667 | A | | 8/1989 | Thompson | |
| 4,925,063 | A | | 5/1990 | Ali et al. | |
| 5,139,182 | A | * | 8/1992 | Appla | 222/519 |
| 5,197,634 | A | * | 3/1993 | Beck | 222/549 |
| 5,356,042 | A | | 10/1994 | Huffman et al. | |
| 5,407,177 | A | | 4/1995 | Lombardo et al. | |
| 5,496,011 | A | | 3/1996 | Samargo et al. | |
| 5,669,427 | A | | 9/1997 | Hasper et al. | |
| 5,901,887 | A | * | 5/1999 | Wark | 222/527 |
| 6,109,467 | A | | 8/2000 | Schliemann et al. | |
| 6,283,331 | B1 | | 9/2001 | Lucas | |

* cited by examiner

*Primary Examiner*—Kenneth Bomberg
(74) *Attorney, Agent, or Firm*—Hovey Williams LLP

(57) ABSTRACT

A flow control device (10) for selectively controlling a flow of a fluid, including a high-viscosity fluid, such as, for example, engine oil, from a relatively large capacity container, such as, for example, a five quart container, wherein the device (10) has a lower port configuration operable to substantially reduce glugging effects, thereby allowing for a maximized rate of fluid transfer through a relatively narrow exit opening (42). The device (10) broadly comprises an adapter (12); a body (14); and a cover (16). The body (14) and cover (16) cooperate to provide fully selectable control over the flow. The fluid flows through ports (36) in either the body (14) or the cover (16), which are movable relative to one another so as to selectively control exposure of the ports (36) to the fluid. Thus, for example, in a first extreme position, the ports (36) are completely blocked and no fluid flows; while in a second extreme position, the ports (36) are completely unblocked and the fluid flows at a maximum rate.

25 Claims, 4 Drawing Sheets

FLOW CONTROL DEVICE FOR LARGE CAPACITY CONTAINER

BACKGROUND OF THE INVENTION

1. Field of the Invention

The present invention relates to spouts, caps, and other similar devices for controlling a flow of a fluid from a container. More particularly, the present invention concerns a device for selectively controlling a flow of a fluid, including a high-viscosity fluid, such as, for example, engine oil, from a relatively large capacity container, such as, for example, a five quart container, wherein the device has a lower port configuration which substantially reduces vacuum or "glugging" effects, thereby allowing for rapid fluid transfer through a relatively narrow exit opening.

2. Description of the Prior Art

It is often desirable to store a high-viscosity fluid in a large capacity container. It will be appreciated, for example, that engine oil is more efficiently packaged, sold, and transported in five quart containers, particularly given that a typical vehicle engine holds approximately five quarts of engine oil.

It is also often desirable, however, to be able to exercise a selectively variable range of control over the flow of the fluid out of the container. Devices are well known in the art that allow for flow control using a variety of control mechanisms, including, for example, movable blockages or valves or other alignable members. Many of these prior art devices, however, are undesirably integral to and non-separable from the container. Thus, the device must be discarded with the container and cannot be reused, which substantially increases manufacturing and purchasing costs. Furthermore, even where the device is separable from the container, the device typically has no mechanism for accommodating differently configured containers, and is therefore undesirably restricted to use with only a limited number of types or brands of containers.

Additionally, it is often desirable to transfer the fluid out of the container as rapidly as possible. While all prior art devices have an associated maximum rate of fluid transfer, a rapid outpouring of fluid can give rise to a vacuum inside the container which slows or opposes any further transfer of the fluid. When this happens, the flow of the fluid is typically partly or wholly interrupted by a "glug" wherein air is quickly sucked into the container to fill the vacuum and allow the fluid to flow again until the next glug. This repetitive interruption of the flow decreases the maximum rate at which the fluid can be transferred.

One known way of minimizing the glugging effect is to make the device's opening larger, thereby either allowing for simultaneous transfer of fluid out of the container and air into the container, or for maximizing the amount of fluid transferred between glugs. Unfortunately, where the fluid is being transferred into a relatively narrow opening, such as an engine oil fill port, aligning this narrow opening with the device's relatively large opening can be difficult to achieve and maintain, particularly considering the substantial size and weight of a full five quart container, thereby potentially resulting in substantial fluid spillage.

Due to these and other problems and disadvantages in the prior art, an improved flow control device is needed.

SUMMARY OF THE INVENTION

The present invention represents a distinct advance in the art of flow control devices. More particularly, the present invention provides a device for selectively controlling a flow of a fluid, including a high-viscosity fluid, such as, for example, engine oil, from a relatively large capacity container, such as, for example, a five quart container, wherein the device has a lower port configuration operable to substantially reduce glugging effects, thereby allowing for a maximized rate of fluid transfer through a relatively narrow exit opening.

In a preferred embodiment the device broadly comprises an adapter; a body; and a cover. The adaptor adapts the device for use with a number of common brands of five quart engine oil containers. The adapter is detachable from the remainder of the device so as to allow for use of the device without the adapter, or for replacement of the adapter with an otherwise identical adapter which is more suitable for use with a particular type or brand of container.

The body cooperates with the cover to control the flow of fluid from the container. A lower cylindrical portion of the body extends into the container and is operable to receive the fluid into the body. A bottom portion of the lower cylinder tapers slightly and is closed. The lower cylinder presents a plurality of ports in the side wall of the cylinder near the bottom portion.

The cover cooperates with the body to control the flow of the fluid from the container. An inner cylindrical portion of the cover provides a conduit through which the fluid can flow to exit the device. A bottom portion of the inner cylinder tapers but is otherwise substantially open. The tapered portion facilitates seating and sealing the bottom portion of the cover against the bottom portion of the lower cylinder of the body.

Rotation of the cover on the body causes the cover to move up or down relative to the body. At a first extreme of such movement, the bottom portion of the inner cylinder of the cover is seated and sealed against the closed bottom portion of the lower cylinder of the body, thereby completely covering or blocking the ports and allowing no fluid to enter the cover. At a second extreme of movement, the bottom portion of the of the inner cylinder of the cover is maximally separated from the closed bottom portion of the lower cylinder of the body, thereby exposing the ports to a maximum degree and allowing a maximum amount of fluid to enter the cover. At any point between these two extremes, the ports are partially exposed, thereby allowing only a correspondingly diminished amount of fluid flow therethrough.

It will be appreciated that the device provides numerous advantages over otherwise similar prior art devices. Because the ports are located low on the device and extend into the container, for example, vacuum effects are reduced when pouring from the otherwise airtight container, thereby increasing flow volume and reducing glugging effects. Furthermore, because the glugging effect is reduced without dependence on the size of the device's opening, the opening can be made small enough to allow for convenient alignment with and pouring into a relatively small port, such as, for example, an engine oil fill port. These advantageous features cooperate to empty the entire contents of a typical five quart engine oil container in approximately one minute and twenty seconds, which is substantially faster than the prior art devices.

These and other important aspects of the present invention are more fully described in the section entitled DETAILED DESCRIPTION OF A PREFERRED EMBODIMENT, below.

BRIEF DESCRIPTION OF THE DRAWINGS

A preferred embodiment of the present invention is described in detail below with reference to the attached drawing figures, wherein.

DETAILED DESCRIPTION OF A PREFERRED EMBODIMENT

Referring to the figures, a flow control device 10 operable to control a flow of a fluid from a large capacity container is shown constructed in accordance with a preferred embodiment of the present invention. The fluid may be any liquid, and the large capacity container may be any such container used for holding the fluid. It should be noted, however, that the device 10 is particularly suited for use in controlling the flow of a high-viscosity fluid such as, for example, engine oil, from a five quart container.

Figure 1:
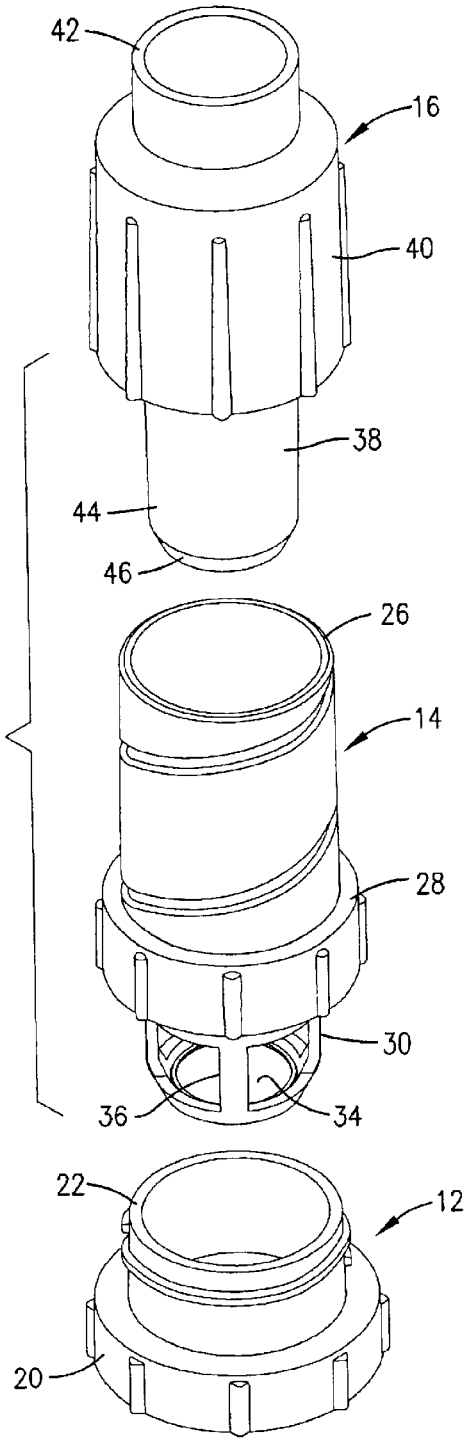
FIG. 1 is an exploded isometric view of a preferred first embodiment of the device of the present invention.
Figure 2:
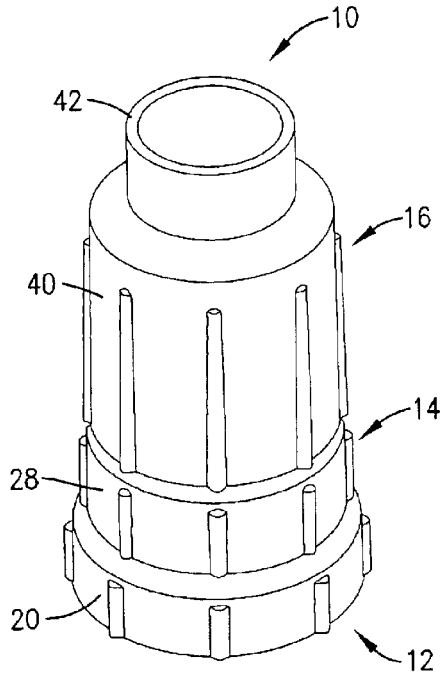
FIG. 2 is an assembled isometric view of the device of FIG. 1.

In a preferred first embodiment, referring particularly to FIGS. 1 and 2, the device 10 broadly comprises an adapter 12; a body 14; and a cover 16. The adaptor 12 adapts the device 10 for use with a number of common brands of five quart engine oil containers. The adapter 12 is detachable from the remainder of the device 10 so as to allow for use of the device 10 without the adapter 12, or for replacement of the adapter 12 with an otherwise identical adapter which is more suitable (with regard to, e.g., size or threads) for use with a particular type or brand of container.

As illustrated, the adapter 12 resembles two inseparably connected hollow cylinders, including a lower cylinder 20 and an upper cylinder 22. The lower cylinder 20 is internally threaded to facilitate coupling the adapter 12 with the container, and is externally knurled or otherwise adapted to facilitate gripping and turning the adapter 12 while coupling or uncoupling it from the container. The upper cylinder 22 is externally threaded to facilitate coupling the adapter 12 with the body 14. The inner radius of the lower cylinder 20 is configured for coupling with containers having a mouth or other opening having a first radius or with threads of a first type (with regard to pattern, pitch, frequency or some other distinguishing characteristic).

The body 14 cooperates with the cover 16 to control the flow of the fluid from the container. As illustrated, the body 14 resembles three inseparably connected hollow cylinders, including an upper cylinder 26, a central cylinder 28, and a lower cylinder 30. The upper cylinder 26 is externally threaded to facilitate coupling the body 14 with the cover 16.

The central cylinder 28 is internally threaded for coupling the body 14 with the externally threaded upper cylinder 22 of the adapter 12, and is externally knurled or otherwise adapted to facilitate gripping and turning the body 14 while coupling or uncoupling it from the adapter 12. When coupled, the upper cylinder 22 of the adapter 12 is received between the lower cylinder 30 and the central cylinder 28 of the body 14.

The central cylinder 28 can, by itself, function to couple the device 10 with the container. Thus, the inner radius of the central cylinder 28 is configured for coupling with containers having a mouth having a second radius or having threads of a second type (with regard to pattern, pitch, frequency or some other distinguishing characteristic), which is different from the first radius or first-type thread to which is the lower cylinder 20 of the adapter 12 is better suited. Thus, by selectively removing or retaining the adapter 12, at least two different sizes of mouths, types of threads, or brands of containers can be accommodated by the device 10.

The lower cylinder 30 is operable to receive the fluid into the body 14. When coupled with the container, the lower cylinder 30 extends into the container whether the adapter 12 is used or not. A bottom 34 of the lower cylinder 30 tapers slightly and is closed. The lower cylinder 30 presents a plurality of ports 36 in the wall of the cylinder near the bottom 34. It is through these ports 36 that the fluid is able to enter the body 14. The ports 36, when the device 10 is in an open position, also extend substantially completely into the container, thereby providing the device 10 with the aforementioned advantageous lower port configuration.

The upper, central, and lower cylinders 26, 28, 30 are inseparably connected to one another at a substantially common point. The upper and lower cylinders 26, 30 are connected so as to provide a continuous enclosed conduit therethrough. The central cylinder 28 surrounds a portion of the lower cylinder 30, and is connected thereto so as not to interfere with the continuity of the conduit.

The cover 16 cooperates with the body 14 to control the flow of the fluid from the container. As illustrated, the cover 16 resembles two inseparably connected hollow cylinders, including an inner cylinder 38 and an outer cylinder 40. The inner cylinder 38 provides a conduit through which the fluid can flow from the lower cylinder 30 of the body 14 and through the cover 16 to exit the device 10. The inner cylinder 38 presents a top portion 42 and a bottom portion 44. The top portion 42 is substantially open so as to allow the fluid to escape the device 10. The bottom portion 44 is also substantially open, but includes a tapered portion 46 resulting in an opening having a smaller diameter than that presented at the top portion 42. The tapered portion 46 facilitates seating and sealing the bottom portion 44 of the cover 16 against the bottom 34 of the lower cylinder 30 of the body 14.

The outer cylinder 40 surrounds and is connected to the inner cylinder 38 to present a substantially annular relationship. The outer cylinder 40 presents an outer surface having knurls or other grip-enhancing mechanisms, and an inner surface which is threaded to correspond to the externally threaded upper cylinder 26 of the body 14. The inner surface includes a cam stop which provides a positive stop to prevent the cover 16 from rotating more than 180° relative to the body 14 between fully opened and fully closed positions.

Figure 3:
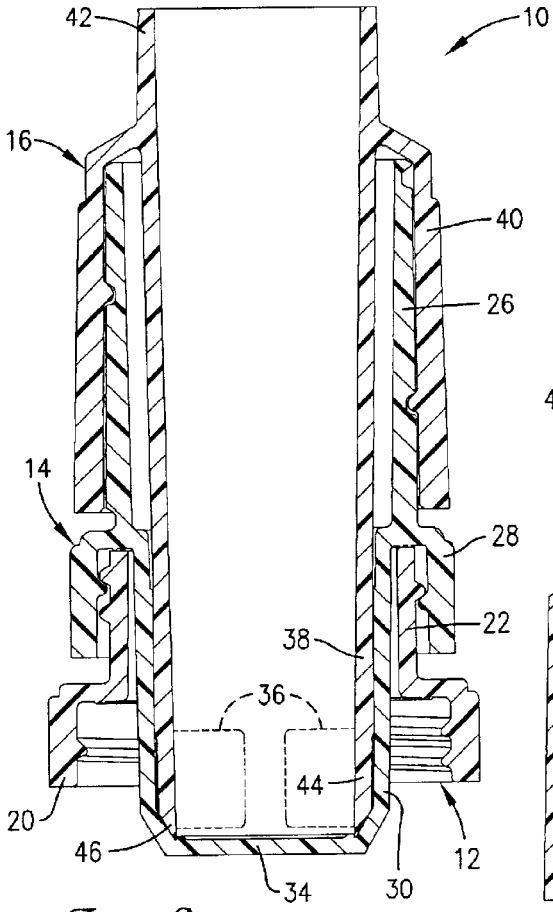
FIG. 3 is a sectional elevation view of the device of FIG. 1, wherein the device is shown in a closed position.
Figure 4:
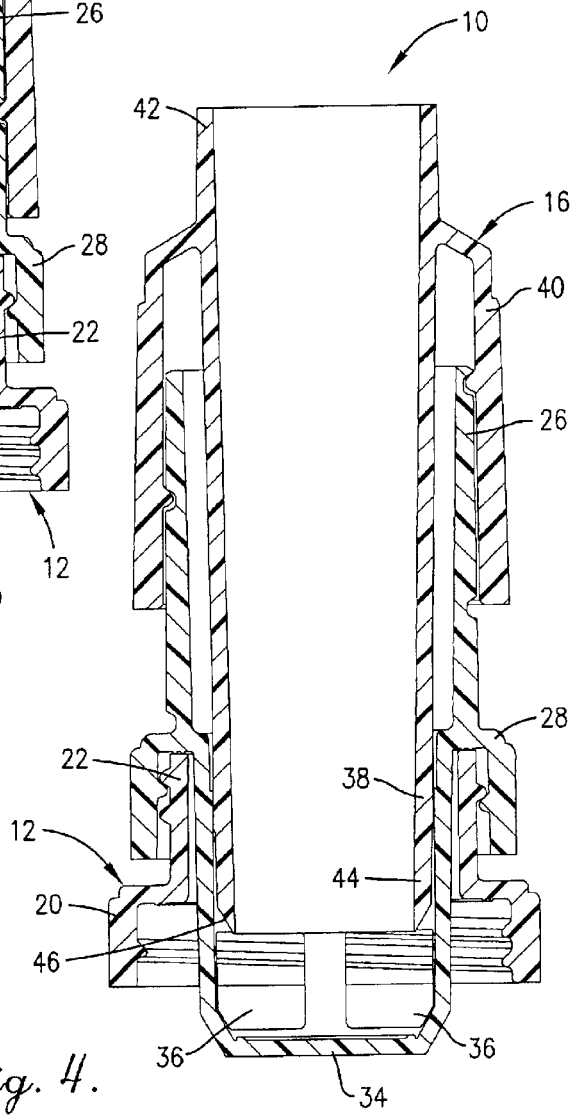
FIG. 4 is a sectional elevation view of the device of FIG. 1, wherein the device is shown in an open position.

Referring also to FIGS. 3 and 4, when coupled with the body 14, the inner cylinder 38 of the cover 16 is received within the conduit formed by the lower and upper cylinders 26, 30 of the body 14, and the externally threaded upper cylinder 26 of the body 14 is received between the inner cylinder 38 and the internally threaded outer cylinder 40 of the cover 16. Thus, rotation of the outer cylinder 40 of the cover 16 about the upper cylinder 26 of the body 14 causes the inner cylinder 38 of the cover 16 to move up or down within the conduit formed by the lower and upper cylinders 26, 30 of the body 14. At a first extreme of such rotation, the bottom 44 of the inner cylinder 38 of the cover 16 is seated and sealed against the closed bottom 34 of the lower cylinder 30 of the body 14, thereby covering the ports 36 and allowing no fluid to enter the body 14 or cover 16. At a second extreme of rotation, which is rotated 180° relative to the first extreme, the bottom of the 44 of the inner cylinder 38 of the cover 16 is maximally separated from the closed bottom 34 of the lower cylinder 30 of the body 14, thereby exposing the ports 36 to a maximum degree and allowing a maximum amount of fluid to enter the body 14 and the cover 16. At any point between these two extremes, the ports 36 are partially exposed, thereby allowing only a correspondingly diminished amount fo fluid flow therethrough.

In use and operation, the device 10 is first coupled with the container by screwing the internally threaded lower cylinder 20 of the adapter 12 onto an externally threaded mouth portion of the container. As mentioned, the adapter 12 may be removed from the remainder of the device 10 and replaced with an otherwise similar adapter that is more suitable in some manner (e.g., diameter, depth, thread type) for use with the particular container. Alternatively, the adapter 12 may be removed altogether, in which case the internally threaded central cylinder 28 of the body 14 may be screwed onto the an externally threaded mouth portion of the container. As previously discussed, the manner in which the device 10 is coupled with the container will depend upon the mouth size, thread type, and brand of the container.

The device 10 is shown in a closed configuration in FIG. 3, wherein the cover 16 has been rotated upon the body 14 such that the lower portion 44 of the inner cylinder 38 of the cover 16 covers and blocks the ports 36, and the tapered portion 46 of the lower portion 44 is seated against the closed bottom 34 of the lower cylinder 30 of the body 14 so that no fluid may flow into the inner cylinder 38. In this closed position, the container may be safely transported without fear of fluid loss through the device 10.

The device 10 is shown in an open configuration in FIG. 4, wherein the cover 16 has been fully rotated 180° upon the body 14 such that the lower portion 44 of the inner cylinder 38 of the cover 16 is raised to fully expose the ports 36 and to unseat the tapered portion 46 from the closed bottom 34 of the lower cylinder 30 of the body 14, so that the fluid may flow through the ports 36, into the inner cylinder 38 of the cover 16 and out its open top 42. It will be appreciated that partially rotating the cover 16 on the body 14 will partially expose the ports 36 to a corresponding degree, thereby allowing for a fully selectable range of control over the flow of the fluid through the device 10.

Figure 5:
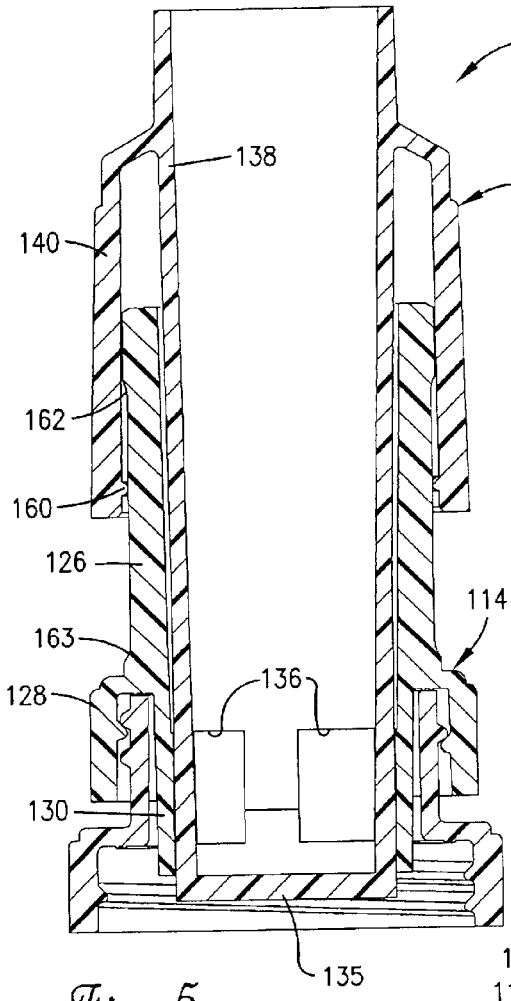
FIG. 5 is a sectional elevation view of a preferred second embodiment of the device of the present invention, wherein the device is shown in a closed position.
Figure 6:
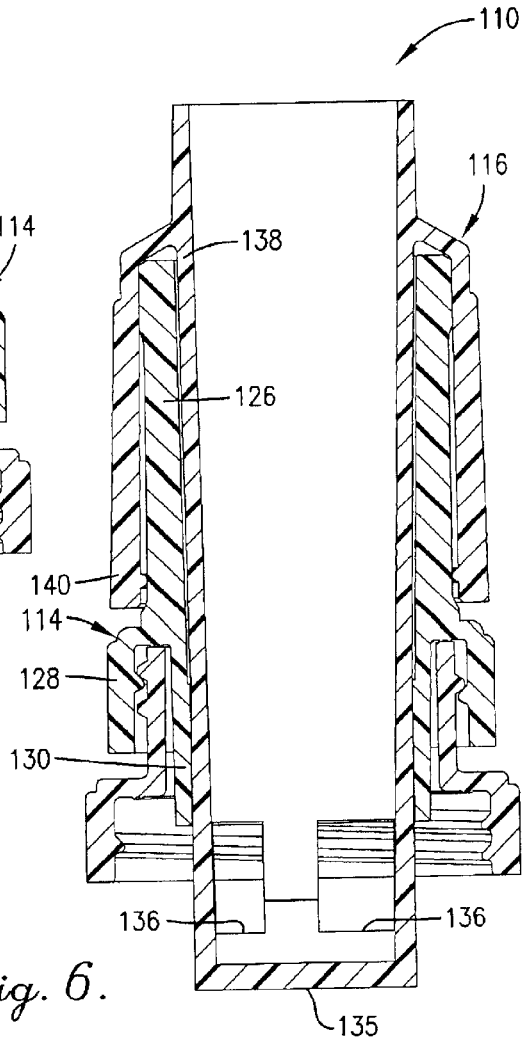
FIG. 6 is a sectional elevation view of the device of FIG. 5, wherein the device is shown in an open position.

Referring to FIGS. 5 and 6, a preferred second embodiment of the device 110 is shown which is substantially similar in many respects to the embodiment of the device 10 described above. In this alternative embodiment, however, the cover 116 is slidably rather than threadably coupled with the body 114, and the ports 136 are incorporated into the inner cylinder 138 of the body 114.

More specifically, in this embodiment, the upper cylinder 126 of the body 114 is not rotatably coupled with the outer cylinder 140 of the cover 116 by threads, as was described above, but is instead slidably received between the inner and outer cylinders 138, 140 of the cover 116 so to allow for sliding motion therebetween. Furthermore, in order to prevent inadvertent removal or other improper motion between the cover 116 and the body 114, the inner surface of the outer cylinder 140 of the cover presents a protrusion 160 or stop, and the outer surface of the upper cylinder 126 of the body 114 presents an upper lip 162 and a lower lip 163, thereby defining the limits of travel. Thus, a first extreme of movement occurs when the protrusion 160 contacts the upper lip 162, corresponding to a fully closed position, and a second extreme of movement occurs when the protrusion 160 contacts the lower lip 163, corresponding to a fully open position.

Furthermore, in this embodiment, the lower cylinder 130 of the body 114 is open at its bottom and presents no ports. Instead, the inner cylinder 138 of the cover is closed at its bottom 135 and presents the ports 136 along the sidewall near the bottom 135, resulting in substantially the same effect as was described above. Thus, when the cover 116 is slid to the first extreme of movement relative to the body 114, as is shown in FIG. 5, the ports 136 presented by the inner cylinder 138 of the cover 116 are completely withdrawn into and closed by the lower cylinder 130 of the body 114, and, as the bottom 135 of the inner cylinder 138 is closed, no fluid can enter the inner cylinder 138. When the cover 116 is slid to the second extreme of movement relative to the body 114, however, as is shown in FIG. 6, the ports 136 are moved out of the lower cylinder 130 of the body 114 so to be entirely exposed to the fluid, thereby allowing the fluid to enter the inner cylinder 138 at a maximum rate.

It will be appreciated that partially sliding the cover 116 on the body 114 will partially expose the ports 136 to a corresponding degree, thereby allowing for a fully selectable range of control over the flow of the fluid through the device 110.

Figure 7:
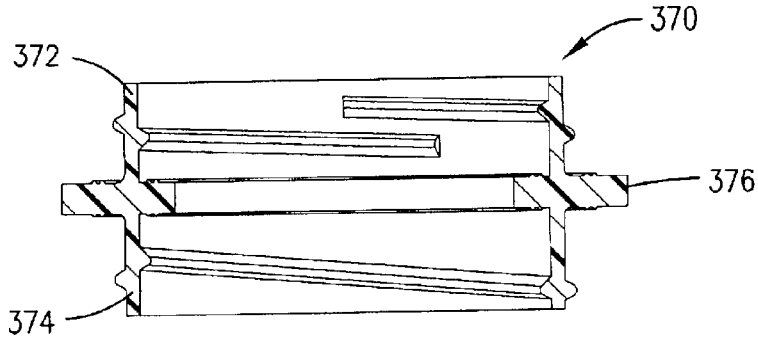
FIG. 7 is a sectional plan view of an optional coupler component for use with both preferred embodiments of the device of the present invention.
Figure 8:
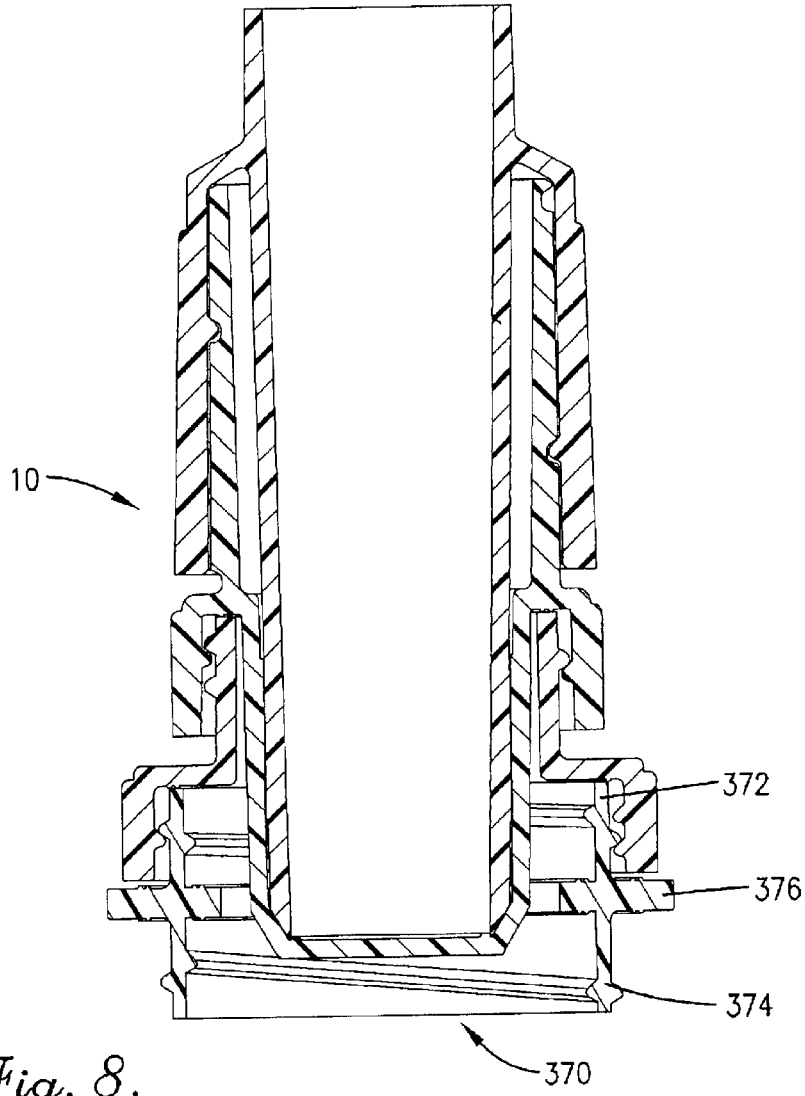
FIG. 8 is a sectional plan view of the coupler component of FIG. 7 coupled with the device of FIG. 1.

Referring also to FIGS. 7 and 8, an optional coupler 370 is shown for use either of the above-described preferred embodiments of the device 10 of the present invention. The coupler 370 is operable to provide the device 10 with even greater versatility with regard to the number of different types of threads or brands of containers with which the device 10 can be used. Whereas, as described above, the removable adapter 12 allowed the device 10 to accommodate two different types of threads, use of the coupler 370 allows the device to accommodate up to four different types of threads.

As illustrated, the coupler 370 resembles a hollow cylinder having a first half 372 and a second half 374 and a circumferential lip 376 surrounding the cylinder's midsection. The first half 372 is externally threaded so as to be removably coupleable with the internally threaded lower cylinder 20 of the adapter 12; and internally threaded so as to be coupleable with a third type of thread (with regard to pattern, pitch, frequency, or some other characteristic). The second half 374 is externally threaded so as to also be removably coupleable with the internally threaded lower cylinder 20 of the adapter 12; and internally threaded so as to be coupleable with a fourth type of thread (with regard to pattern, pitch, frequency, or some other characteristic). The circumferential lip 376 provides a gripping portion for facilitating turning the coupler 370 when threading or unthreading it from the adapter 12.

In use and operation, a user of the device 10 finds that neither the central cylinder 28 of the body 14 nor the lower cylinder 20 of the adapter 12 provides the proper type of internal thread for coupling the device 10 with a particular container. The user determines, however, that the first half 372 of the coupler 370 does provide the propertype of internal thread. By coupling the second half 374 of the coupler 370 with the adapter 12, the adapter 12 with the body 14, and the first half 372 of the coupler 370 with the container, the device 10 is properly coupled with the container and can be thereafter used in a normal manner.

It will be appreciated that the various embodiments of the device 10, 110 of the present invention provide numerous advantages over otherwise similar prior art devices. Because the ports 36, 136 are located low on the device 10, 110 and extend into the container, for example, vacuum effects are reduced when pouring from the otherwise airtight container, which increases flow volume and reduces "glugging" effects. Furthermore, the lower port configuration allows for a fluid exit 42 opening which is sized smaller than a typical engine oil fill port, thereby allowing for easier guiding and pouring of the oil. These advantageous features cooperate to empty the entire contents of a typical five quart engine oil container in approximately one minute and twenty seconds, which is substantially faster than the prior art devices.

Furthermore, because the glugging effect is reduced without dependence on the size of the device's opening 42, the opening 42 can be made small enough to allow for convenient alignment with and pouring into a relatively small port, such as, for example, an engine oil fill port.

From the preceding description, it can be seen that the present invention provides a device for selectively controlling a flow of a fluid, including a high-viscosity fluid, such as, for example, engine oil, from a relatively large capacity container, such as, for example, a five quart container, wherein the device has a lower port configuration operable to substantially reduce glugging effects, thereby allowing for a maximized rate of fluid transfer through a relatively narrow exit opening.

Although the invention has been described with reference to the preferred embodiment illustrated in the attached drawings, it is noted that equivalents may be employed and substitutions made herein without departing from the scope of the invention as recited in the claims. Thus, for example, a variety of coupling schemes, other than the rotatable and slidable mechanisms disclosed herein, may be used to operatively couple the cover with the body.

Having thus described the preferred embodiment of the invention, what is claimed as new and desired to be protected by Letters Patent includes the following:

1. A device for controlling a flow of a fluid out of a container, the device comprising:

a body removably coupleable with a mouth of the container and providing a port through which the fluid can pass into an interior area of the device, wherein the body extends into the container such that the port is substantially located within the container; and a cover comprising an inner hollow cylinder and an outer hollow cylinder, wherein the inner cylinder extends through the body and provides a conduit for the flow of the fluid through the device, wherein an inner surface of the outer cylinder is movably coupled with the body to allow the device to provide a selectively retractable blockage of the port, and wherein the cover may be moved between a closed position in which the port is completely covered and the flow of the fluid is stopped, and an open position in which the port is completely open and the flow of the fluid is maximized wherein the body is substantially cylindrical, having a body bottom and a lower side wall, with the bottom being closed and the port being located on the lower side wall near the bottom.

2. The device as set forth in claim 1, wherein the cover is substantially cylindrical, having a cover bottom and a cover top, with the cover bottom and the cover top both being substantially open to allow the fluid to, respectively, enter and exit the device, wherein the cover bottom fits within the body bottom and rests against and is closed by the body bottom when the cover is in the closed position.

3. A device for controlling a flow of a fluid out of a container, the device comprising:

a body removably coupleable with a mouth of the container and providing a port through which the fluid can pass into an interior area of the device, wherein the body extends into the container such that the port is substantially located within the container; and a cover comprising an inner hollow cylinder and an outer hollow cylinder, wherein the inner cylinder extends through the body and provides a conduit for the flow of the fluid through the device, wherein an inner surface of the outer cylinder is movably coupled with the body to allow the device to provide a selectively retractable blockage of the port, and wherein the cover may be moved between a closed position in which the port is completely covered and the flow of the fluid is stopped, and an open position in which the port is completely open and the flow of the fluid is maximized further including an adapter operable to be removably coupled with the body and to be removably coupleable with a mouth of the container, thereby adapting the device for use with the container.

4. A device for controlling a flow of a fluid out of a container, the device comprising:

an adapter operable to allow for removably coupling the device with a mouth of the container;

a body coupled with the adapter and providing a port through which the fluid can pass into an interior area of the device, wherein the body extends through the adapter and into the container such that the port is substantially located within the container; and a cover comprising an inner hollow cylinder and an outer hollow cylinder, wherein the inner cylinder extends through the body and provides a conduit for the flow of the fluid through the device, wherein an inner surface of the outer cylinder is movably coupled with the body to allow the device to provide a selectively retractable blockage of the port, and wherein the cover may be moved between a closed position in which the port is completely covered and the flow of the fluid is stopped, and an open position in which the port is completely open and the flow of the fluid is maximized.

5. The device as set forth in claim 4, wherein the fluid is a high-viscosity fluid and the container is a large capacity container.

6. The device as set forth in claim 4, wherein the fluid is engine oil and the container is a five quart container.

7. The device as set forth in claim 4, wherein the adapter is internally threaded to facilitate coupling and uncoupling the device from the mouth of the container.

8. The device as set forth in claim 4, wherein the adapter is removable from the remainder of the device for replacement with a second adapter which is better suited for use with a particular container.

9. The device as set forth in claim 4, wherein the body is substantially cylindrical, having a body bottom and a lower side wall, with the bottom being closed and the port being located on the lower side wall near the bottom.

10. The device as set forth in claim 9, wherein the cover is substantially cylindrical, having a cover bottom and a cover top, with the cover bottom and the cover top both being substantially open to allow the fluid to, respectively, enter and exit the device, wherein the cover bottom fits within the body bottom and rests against and is closed by the body bottom when the cover is in the closed position.

11. The device as set forth in claim 4, wherein the cover is rotatably coupled with the body.

12. The device as set forth in claim 4, wherein the cover is slidably coupled with the body.

13. The device as set forth in claim 4, wherein the cover may be moved to any position between the closed position and the open position to correspondingly control the flow of the fluid through the device.

14. A device for controlling a flow of a fluid out of a container, the device comprising:

an adapter operable to allow for removably coupling the device with a mouth of the container;

a body coupled with the adapter and providing a port through which the fluid can pass into an interior area of the device, wherein the body extends through the adapter and into the container such that the port is substantially located within the container;

a cover movably coupled with the body to provide a selectively retractable blockage of the port, wherein the cover may be moved between a closed position in which the port is completely covered and the flow of the fluid is stopped, and an open position in which the port is completely open and the flow of the fluid is maximized; and a coupler operable to be removably interposed between the adapter and a second-type mouth of a particular container, and which is better suited than the adapter to removably couple the device to the second-type mouth of the particular container.

15. A device for controlling a flow of a high-viscosity fluid out of a large capacity container, the device comprising:

an adapter operable to allow for removably coupling the device with a first-type mouth of the container, wherein the adapter is internally threaded to facilitate coupling and uncoupling the device from the first-type mouth of the container;

a body coupled with the adapter and providing a port through which the fluid can pass into an interior area of the device, wherein the body extends through the adapter and into the container such that the port is substantially located within the container; and a cover comprising an inner hollow cylinder and an outer hollow cylinder, wherein the inner cylinder extends through the body and provides a conduit for the flow of the fluid through the device, wherein an inner surface of the outer cylinder is movably coupled with the body to allow the device to provide a selectively retractable blockage of the port, and wherein the cover can be moved between a closed position in which the port is completely covered and the flow of the fluid is stopped, and an open position in which the port is completely open and the flow of the fluid is maximized, and wherein the cover can be moved to any position between the closed position and the open position to correspondingly control the flow of the fluid through the device.

16. The device as set forth in claim 15, wherein the fluid is engine oil and the container is a five quart container.

17. The device as set forth in claim 15, wherein the adapter is removable from the remainder of the device for replacement with a second adapter which is better suited for use with a particular container.

18. The device as set forth in claim 15, wherein the body is substantially cylindrical, having a body bottom and a lower side wall, with the bottom being closed and the port being located on the lower side wall near the bottom.

19. The device as set forth in claim 18, wherein the cover is substantially cylindrical, having a cover bottom and a cover top, with the cover bottom and the cover top both being substantially open to allow the fluid to, respectively, enter and exit the device, wherein the cover bottom fits within the body bottom and rests against and is closed by the body bottom when the cover is in the closed position.

20. The device as set forth in claim 15, wherein the cover is rotatably coupled with the body.

21. The device as set forth in claim 15, wherein the cover is slidably coupled with the body.

22. A device for controlling a flow of a high-viscosity fluid out of a large capacity container, the device comprising:

an adapter operable to allow for removably coupling the device with a first-type mouth of the container, wherein the adapter is internally threaded to facilitate coupling and uncoupling the device from the first-type mouth of the container;

a body coupled with the adapter and providing a port through which the fluid can pass into an interior area of the device, wherein the body extends through the adapter and into the container such that the port is substantially located within the container;

a cover movably coupled with the body to provide a selectively retractable blockage of the port, wherein the cover can be moved between a closed position in which the port is completely covered and the flow of the fluid is stopped, and an open position in which the port is completely open and the flow of the fluid is maximized, and wherein the cover can be moved to any position between the closed position and the open position to correspondingly control the flow of the fluid through the device; and a coupler having a first end and a second end, with the first end being externally threaded to allow for removably coupling with the internally threaded adapter and the first end also being internally threaded to allow for removably coupling with a second-type mouth, and with the second end being externally threaded to allow for removably coupling with the internally threaded adapter and the second end also being internally threaded to allow for removably coupling with a third-type mouth.

23. A device for controlling a flow of an engine oil fluid out of a five quart container, the device comprising:

an adapter which is internally threaded to allow for removably coupling the device with a first-type mouth of the five quart container;

a coupler having a first end and a second end, with the first end being externally threaded to allow for removably coupling with the internally threaded adapter and the first end also being internally threaded to allow for removably coupling with a second-type mouth, and with the second end being externally threaded to allow for removably coupling with the internally threaded adapter and the second end also being internally threaded to allow for removably coupling with a third-type mouth;

a body coupled with the adapter and providing a port through which the fluid can pass into an interior area of the device, wherein the body is substantially cylindrical and extends through the adapter and into the container, wherein the body has a body bottom and a lower side wall located substantially within the container, with the body bottom being closed and the port being located on the lower side wall near the body bottom; and a cover movably coupled with the body and providing a selectively retractable blockage of the port, wherein the cover is substantially cylindrical, having a cover bottom and a cover top, with the cover bottom and the cover top both being substantially open to allow the fluid to, respectively, enter and exit the device, wherein the cover bottom fits within the body bottom and rests against and is closed by the body bottom when the cover is in a closed position, wherein the cover can be moved between the closed position in which the port is completely covered and the flow of the fluid is stopped, and an open position in which the port is completely open and the flow of the fluid is maximized, and wherein cover can be moved to any position between the closed position and the open position to correspondingly control the flow of the fluid through the device.

24. The device as set forth in claim 23, wherein the cover is rotatably coupled with the body.

25. The device as set forth in claim 23, wherein the cover is slidably coupled with the body.

* * * * *